US006085844A

United States Patent [19]

Palmer et al.

[11] Patent Number: 6,085,844

[45] Date of Patent: Jul. 11, 2000

[54] METHOD FOR REMOVAL OF UNDESIRED FLUIDS FROM A WELLBORE

[75] Inventors: Bentley J. Palmer, Missouri City; Dean M. Willberg, Sugar Land; Patrick W. Bixenman, Houston; Philip F. Sullivan, Bellaire, all of Tex.

[73] Assignee: Schlumberger Technology Corporation, Sugar Land, Tex.

[21] Appl. No.: 09/196,278

[22] Filed: Nov. 19, 1998

[51] Int. Cl.[7] ..... E21B 21/10

[52] U.S. Cl. ..... 166/312; 166/77.2

[58] Field of Search ..... 166/312, 311, 166/223, 77.2; 175/62, 73, 67

[56] References Cited

U.S. PATENT DOCUMENTS

| | | |
|---|---|---|
| 2,756,209 | 7/1956 | Morgan . |
| 2,811,488 | 10/1957 | Nestle et al. . |
| 3,046,222 | 7/1962 | Phansalkar et al. . |

(List continued on next page.)

FOREIGN PATENT DOCUMENTS

| | | |
|---|---|---|
| 2066685 C1 | 9/1993 | Russian Federation . |
| 2021320 C1 | 10/1994 | Russian Federation . |
| 2169018 | 7/1986 | United Kingdom . |
| WO 93/01333 | 1/1993 | WIPO . |
| WO 93/1928 | 9/1993 | WIPO . |

OTHER PUBLICATIONS

Lisa A. Cantu & Phil A. Boyd, "Laboratory and Field Evaluation of a Combined Fluid–Loss–Control Additive and Gel Breaker for Fracturing Fluids," *SPE Production Engineering*, pp. 253–260,Aug. 1990.

A. Gyr and H. W. Bewersdorff, "Drag Reduction in Fibre–and Non–Fibrous Suspensions", *Drag Reduction of Turbulent Flows by Additives*, pp. 175–190 (1995).

Gray et al, "Composition and Properties of Oil Well Drilling Fluids", pp. 579–582 (1980).

Joseph S. Hayes, Jr., "Kynol Novoloid Fibers in Friction and Sealing Materials", *American Kynol, Inc.*, pp. 1–2 (1981).

Simon G. James, Michael L. Samuelson, Glenn W. Reed, Steven C. Sullivan, "Proppant Flowback Control in High Temperature Wells", *SPE 39960*, pp. 1–7 (Apr., 1998).

Minthorn & Garvin, "Successful Application of New Technology in Antrim Shale Completions", *SPE 23421*, pp. 71–76 (1991).

Hiroshi Mizunuma & Hiroshi KATO, "Frictional Resistance in Fiber Suspensions", *Bulletin of the JSME*, vol. 26, #219, pp. 1567–1574, Sep. 1983.

C. A. Parker & A. H. Hedley, "A Structural Basis for Drag–Reducing Agents", *Journal of Applied Polymer Science*, vol. 18, pp. 3403–3421, 1974.

M. T. Thew & J. S. Anand, "Characterising Asbestos Fibres Suitable For Drag Reduction", International Conference on Drag Reduction, paper. D2–15–30, Sep., 1974.

R. S. Sharma, V. Seshadri, R. C. Malhotra, "Drag Reduction by Centre–Line Injection of Fibres in a Polymeric Solution", *The Chemical Engineering Journal*, vol. 18, pp. 73–79, 1979.

R. S. Sharma, V. Seshadri, R. C. Malhotra, "Drag Reduction in Dilute Fibre Suspensions: Some Mechanistic Aspects", *Chemical Engineering Science*, vol. 34, pp. 703–713, 1979.

J. P. Malhotra, S. R. Deshmukh, R. P. Singh, "Turbulent Drag Reduction by Polymer–Fiber Mixtures", *Journal of Applied Polymer Science*, vol. 33, pp. 2467–2478, 1987.

G. V. Reddy, R. P. Singh, "Drag reduction effectiveness and shear stability of polymer–polymer and polymer–fibre mixtures in recirculatory turbulent flow of water", *Rheol Acta*, 24 pp. 296–311, 1985.

(List continued on next page.)

*Primary Examiner*—Frank Tsay

*Attorney, Agent, or Firm*—Gordon G. Waggett; Robin C. Nava

[57] ABSTRACT

An improved method for cleanout of subterranean wells, such as hydrocarbon wells, is disclosed, the method being characterized by utilization of specified translocating fibers and/or platelets to aid in reduction of undesired fluids in the wellbore.

35 Claims, 1 Drawing Sheet

U.S. PATENT DOCUMENTS

| | | | |
|---|---|---|---|
| 3,409,499 | 11/1968 | Dresher et al. . | |
| 3,593,798 | 7/1971 | Darley . | |
| 3,601,194 | 8/1971 | Gallus . | |
| 3,662,828 | 5/1972 | Hutchison | 166/312 |
| 3,694,308 | 9/1972 | Botz . | |
| 3,774,683 | 11/1973 | Smith et al. . | |
| 3,853,176 | 12/1974 | Henrich | 166/222 |
| 3,854,533 | 12/1974 | Gurley et al. . | |
| 3,891,565 | 6/1975 | Colpoys . | |
| 3,973,627 | 8/1976 | Hardy et al. . | |
| 4,160,755 | 7/1979 | Choe et al. . | |
| 4,173,999 | 11/1979 | Messenger . | |
| 4,272,495 | 6/1981 | Stewart et al. . | |
| 4,284,538 | 8/1981 | Graham . | |
| 4,289,632 | 9/1981 | Clear . | |
| 4,330,337 | 5/1982 | Graham . | |
| 4,330,414 | 5/1982 | Hoover . | |
| 4,361,465 | 11/1982 | Graham . | |
| 4,370,169 | 1/1983 | Graham . | |
| 4,381,199 | 4/1983 | Graham . | |
| 4,392,964 | 7/1983 | House et al. . | |
| 4,428,843 | 1/1984 | Cowan et al. . | |
| 4,439,328 | 3/1984 | Moity . | |
| 4,526,240 | 7/1985 | McKinley et al. . | |
| 4,527,627 | 7/1985 | Graham et al. . | |
| 4,605,329 | 8/1986 | Duffy . | |
| 4,671,359 | 6/1987 | Renfro | 166/312 |
| 4,694,901 | 9/1987 | Skinner | 166/77 |
| 4,708,206 | 11/1987 | Jennings, Jr. . | |
| 4,765,410 | 8/1988 | Rogers et al. | 166/303 |
| 4,793,417 | 12/1988 | Rumbaugh | 166/312 |
| 4,871,284 | 10/1989 | Duffy . | |
| 4,875,525 | 10/1989 | Mana . | |
| 5,222,558 | 6/1993 | Montgomery et al. . | |
| 5,251,697 | 10/1993 | Shuler . | |
| 5,330,005 | 7/1994 | Card et al. . | |
| 5,354,456 | 10/1994 | Montgomery et al. . | |
| 5,377,760 | 1/1995 | Merrill . | |
| 5,439,055 | 8/1995 | Card et al. . | |
| 5,501,274 | 3/1996 | Nguyen et al. . | |
| 5,501,275 | 3/1996 | Card et al. . | |
| 5,551,514 | 9/1996 | Nelson et al. . | |
| 5,582,249 | 12/1996 | Caveny et al. . | |
| 5,591,699 | 1/1997 | Hodge . | |
| 5,597,784 | 1/1997 | Sinclair et al. . | |
| 5,652,058 | 7/1997 | Nagata et al. . | |
| 5,679,149 | 10/1997 | Tezuka et al. . | |
| 5,685,902 | 11/1997 | Tezuka et al. . | |
| 5,984,011 | 11/1999 | Misselbrook et al. | 166/312 |

OTHER PUBLICATIONS

P. F. W. Lee & G. G. Duffy, "An analysis of the drag reducing regime of pulp suspension flow", *Tappi*, vol. 59, #8, pp. 119–122, Aug., 1976.

Gunnar Hemstrom, Klaus Moller, Bo Norman, "Boundary layer studies in pulp suspension flow", *Tappi*, vol. 59, #8, 115–118, Aug., 1976.

"Mechanism of Drag Reduction in Turbulent Pipe Flow by the Addition of Fibers", *Ind. Eng. Chem. Fundam*, vol. 20, pp. 101–102, 1981.

I. Radin, J. L. Zakin, G. K. Patterson, "Drag Reduction in Solid–Fluid Systems", *AIChE Journal*, vol. 21, #2, pp. 358–371, Mar., 1975.

D. D. Kale and A. B. Metzner, "Turbulent Drag Reduction in Fiber–Polymer Systems: Specificity Considerations", *AIChE Journal*, vol. 20, #6, pp. 1218–1219, Nov., 1974.

Peter F. W. Lee and Geoffrey G. Duffy, "Relationships Between Velocity Profiles and Drag Reduction in Turbulent Fiber Suspension Flow", *AIChE. Journal*, vol. 22, #4, pp. 750–753, Jul., 1976.

"Drag Reduction in the Turbulent Flow of Fiber Suspensions", *AIChE Journal*, vol. 20, #2, pp. 301–306, Mar., 1974.

W. K. Lee, R. C. Vaseleski and A. B. Metzner, "Turbulent Drag Reduction in Polymeric Solutions Containing Suspended Fibers", *AIChE Journal*, vol. 20, #1, pp. 128–133, Jan., 1974.

Arthur B. Metzner, "Polymer solution and fiber suspensions rheology and their relationship to turbulent drag reduction", *The Physics of Fluids*, vol. 20, #10, PT 11, pp. S145–149, Oct., 1977.

W. D. McComb & K. T. J. Chan, "Drag reduction in fibre suspensions: transitional behaviour due to fibre degradation", *Nature*, vol. 280, pp. 45–46, Jul., 1979.

W. D. McComb & K. T. J. Chan, "Drag reduction in fibre suspension", *Nature*, vol. 292, pp. 520–522, Aug., 1981.

J. G. Savins, "Drag reducing additives improve drilling fluid hydraulics", *Oil & Gas Journal*, pp. 79–86, Mar. 13, 1995.

"Effective Remediation of Lost Circulation Slot Sealing Test Results", *Montello Pheno Seal Publication*, pp. 1–3, 1997.

Aston, M.S., "Techniques for Solving Torque and Drag Problems in Today's Drilling Environment", SPE Article 48939, BP Exploration, Sunbury, England, pp. 55–68 (1998).

Kelco Oil Field Group, "Microfibrous Cellulose", *Developmental Product Bulletin*, Mar. 1997.

4$^{th}$ Annu Petrol Network Educ Conf (Pnec) Emerging Technol Int Conf (Aberdeen, Scot, 96.06.05–06) Proc PAP No. 16, 1996 (Abs.).

Amer Chem Soc Polymeric Matter Sci Eng Div Tech Program (Anaheim, Calif, 86.09.07–12) Proc (192$^{nd}$ Acs Nat Mtg) V 55, pp 880–888, 1986 (ISBN 0–8412–0985–5;4 Refs) (Abs.).

Encyclopedia of Chemical Technology (Kirk–Othmer) (Third Edition) 1980, pp. 148–197.

P. R. Howard, M. T. King, M. Morris, J–P Feraud, G. Slusher, and S. Lipari, "Fiber/Proppant Mixtures Control Proppant Flowback in South Texas", *SPE 30495*, pp. 1–12, Oct., 1995.

FIG.1
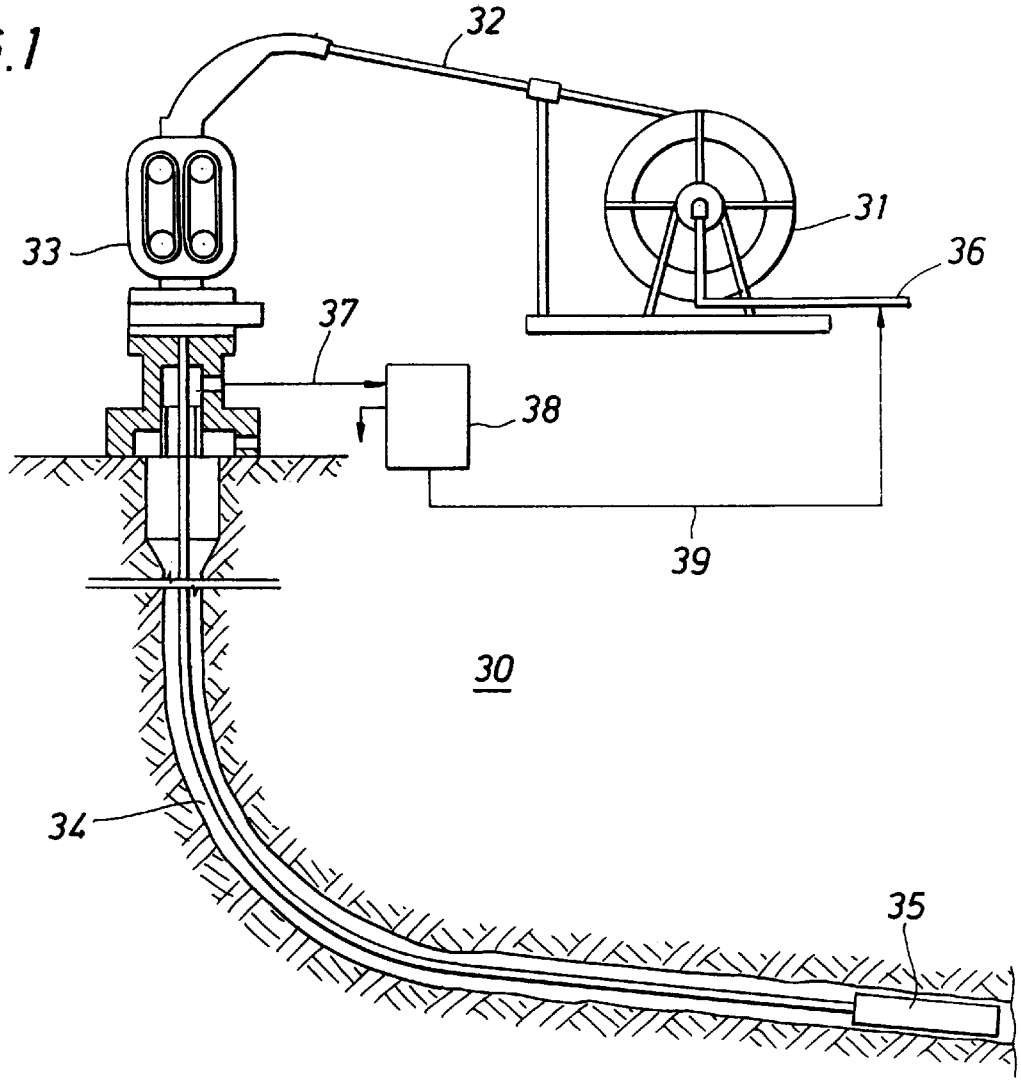
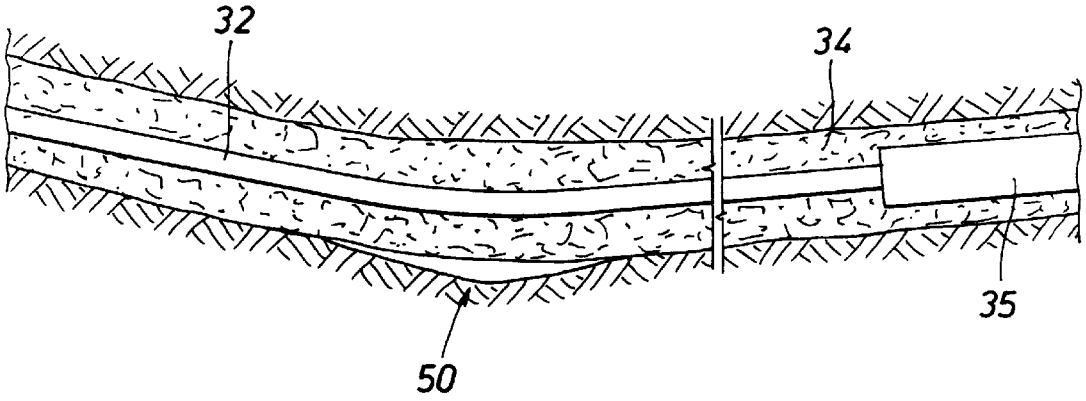
FIG.2

METHOD FOR REMOVAL OF UNDESIRED FLUIDS FROM A WELLBORE

FIELD OF THE INVENTION

The invention relates to the removal of undesired fluids from subterranean wells, particularly hydrocarbon wells. The invention especially concerns the removal of collections of undesired fluids in wellbores in cleanout operations.

BACKGROUND OF THE INVENTION

Localized collection(s) of an undesired fluid or fluids may develop in a wellbore from various sources, and such collections or deposits may pose significant problems in wellbore operations. In general, an "undesired fluid" in a wellbore is any fluid (including mixtures thereof) which may interfere with a working fluid or with recovery of a production fluid such as oil and/or gas. For example, collection of an aqueous fluid or fluids, such as a heavy brine, in a hydrocarbon well prior to or during the course of production may hinder or reduce the production rate of the well, and may require expensive cleanout operations to remove the undesired fluid(s).

The problem of collection or deposition of undesired fluids is of particular concern in so-called "deviated" or curved wellbores, wellbores which depart significantly from vertical orientation. Particularly where the deviated wellbore is drilled with a downhole driving source, deviated wellbores commonly contain "dips" or depressions due principally to orientation shifts of the bit while drilling. The depressions, because of their horizontal component, provide locations or sites which are especially susceptible to collection of undesired fluid or fluids. These collections or "pools" of undesired fluids restrict the cross-section of the wellbore which is open to flow of the working or production fluid. While drilling fluid pressure is normally sufficient to maintain drilling mud movement during drilling operations, production fluid pressure may be significantly less, and the density differential between production fluid and the intruding liquid(s) can pose operational difficulties. Additionally, production fluids may not be miscible with a dense undesired fluid material, such as a heavy brine, and may not be able to displace or transport the undesired fluid.

A need, therefore, has existed for providing an effective "cleanout" means or method for elimination or removal of undesired fluid or fluids from wellbores. The invention addresses this need.

SUMMARY OF THE INVENTION

Accordingly, the invention relates to a method in which a collection or deposit of an undesired fluid in a wellbore is contacted with a wellbore fluid containing translocating fibers and/or platelets, the wellbore fluid being provided in an amount and at a rate effective or sufficient to remove undesired fluid from the deposit. Further according to the invention, wellbore fluid containing translocating fibers and/or platelets, after contacting and reducing the deposit, is returned to the earth surface with or containing undesired fluid from the deposit. Depending on the wellbore or cleanout fluid employed, some or all of the undesired fluid may actually be dissolved in the wellbore fluid, or a portion may be suspended or perhaps emulsified in the wellbore fluid. In some instances, the undesired fluid may also be moved or pushed through the wellbore as a "slug" by the wellbore fluid and fiber. The undesired fluid and fibers and/or platelets may be removed, as hereinafter described, from the wellbore fluid mixture, leaving a wellbore fluid which may be recovered or reused, or undesired fluid may be removed, leaving a fibers and/or platelets-containing fluid which may be recovered or reused. Alternatively, the wellbore fluid mixture, i.e., wellbore fluid containing fibers and/or platelets and undesired fluid, may simply be sent to disposal. As used herein, the term "translocating", with reference to the fibers and/or platelets employed, refers to the capability of the fibers and/or platelets, in conjunction with wellbore fluid, to initiate movement of undesired fluid into the wellbore fluid from a deposit or collection thereof in the wellbore. Translocating fibers and/or platelets, therefore, will be of sufficient size and stiffness as to exert a mechanical force individually or in aggregation as a network on undesired fluid(s) deposits such that solution, suspension, emulsion, or movement in the wellbore fluid is promoted. In each instance, as employed herein, the phrase "and/or" is used to indicate that the terms or expressions joined thereby are to be taken together or individually, thus providing three alternatives enumerated or specified. While there is no desire to be bound by any theory of invention, evidence suggests that during moderate circulation of a fibers-containing fluid over or in contact with collections of difficulty assimilatable liquid, the fibers promote or assist in liquid interface disturbance, thus bringing the liquid to be removed into the fibers'-containing fluid. The intent of the invention, therefore, is to utilize the fibers and/or platelets in active wellbore cleanout, the fibers and/or platelets being maintained in suspension in the fluid in the wellbore annulus and generally without significant aggregation during use. Mixtures of translocating fibers and platelets may be used, and as used hereinafter, the term "fibers" is understood to include mixtures of different fibers, of differing sizes and types, and the term "platelets" is to be similarly understood. The invention is particularly adapted to the cleanout of deviated wells, and is especially addressed to reducing or removing undesired fluid deposits in coiled tubing cleanout operations.

BRIEF DESCRIPTION OF THE DRAWING

FIGS. 1 and 2 together illustrate schematically a coiled tubing operation in which a fibers-containing fluid is employed to remove undesired fluid collected in a deviated wellbore. FIG. 2 illustrates particularly the effect of fibers usage on the collected undesired fluid.

DETAILED DESCRIPTION OF THE INVENTION

Any suitable wellbore or cleanout fluid, as the operation may require, may be used, it being recognized that such "fluid" may comprise mixtures and various components. The particular wellbore fluid chosen, therefore, per se forms no part of the present invention. Accordingly, the wellbore or cleanout fluid may be aqueous or non-aqueous, including hydrocarbon fluids, and may comprise a gas or gases, i.e., fiber-containing foams may be employed, and the fluids may also include usual viscosifying agents and components which may aid in collection. In general, any wellbore or cleanout fluid commonly used may be employed in the invention, keeping the requirements specified herein-after in mind, preferred fluids comprising water, water-in-oil or oil-in-water emulsions, and oil or hydrocarbon-based fluids, e.g. diesel. Carbon dioxide and nitrogen are preferred foaming gases.

As those skilled in the art will appreciate, however, the wellbore fluid, translocating fibers and/or platelets and any other components must be compatible or generally inert with respect to each other. As understood herein, the components of the fluid are taken to be "inert" if they do not react with one another, degrade, or dissolve, faster than a desired rate, or otherwise individually or in combination deleteriously interfere to any significant extent with the designed functions of any component, thus permitting the use, as described hereinafter, of fibers, platelets, or other components in the fluid which may react, degrade, or dissolve over time.

Proportions of the components of the wellbore fluid suspension, including those of the fibers and/or platelets, will be selected to insure that fluid character, i.e., flowability, and suspension or dispersion of the fibers and/or platelets, are maintained during pumping or down well transport, and during "upwell" movement of the wellbore fluid mixture or suspension of fibers and/or platelets, recovered or removed undesired fluid, and any transported particulate matter. That is, an amount of wellbore fluid or liquid is provided or present which is sufficient to insure fluidity or fluid flow characteristics for all the material to be transported. In conjunction with the amount of fluid utilized, the fibers and/or platelets will be present in the fluid in a concentration effective to achieve the desired purpose, e.g., reduce or remove deposits of collected undesired fluid. Preferably, the fibers and/or platelets level, i.e., concentration, used in the wellbore fluid may range from about 0.01 percent by weight to 10 percent by weight of the fluid, depending on the nature of the fibers. For example, metal fibers will normally be provided at a higher weight basis than polyester fibers. Most preferably, however, the fibers and/or platelets concentration ranges from about 0.1 percent to about 5.0 percent by weight of fluid. Unless otherwise specified or evident from the context, all percentages given herein are by weight, based on the weight of the fluid.

The fibers employed according to the invention may have a wide range of dimensions and properties. As employed herein, the term "fibers" refers to bodies or masses, such as filaments, of natural or synthetic material(s) having one dimension significantly longer than the other two, which are at least similar in size, and further includes mixtures of such materials having multiple sizes and types. As indicated previously, the translocating fibers employed will be of sufficient size and stiffness such that removal of undesired fluid from a deposit thereof is assisted or promoted. Preferably, in accordance with the invention, individual fiber lengths may range upwardly from about 0.5 millimeter, preferably 1 mm or so. Practical limitations of handling, mixing, and pumping equipment in wellbore applications currently limit the practical use length of the fibers to about 100 millimeters. Accordingly, a preferred range of fiber length will be from about 1 mm to about 100 mm or more, with a most preferred length being from at least about 2 mm up to about 30 mm. Similarly, fiber diameters will preferably range upwardly from about 5 microns, a preferred range being from about 5 microns to about 40 microns, most preferably from about 8 microns to about 20 microns, depending on the modulus of the fiber, as described more fully hereinafter. A ratio of length to diameter (assuming the cross section of the fiber to be circular) in excess of 50 is preferred. However, the fibers may have a variety of shapes ranging from simple round or oval cross-sectional areas to more complex shapes such as trilobe, figure eight, star-shape, rectangular cross-sectional, or the like. Preferably, generally straight fibers with round or oval cross sections will be used. Curved, crimped, branched, spiral-shaped, hollow, fibrillated, and other three dimensional fiber geometries may be used. Again, the fibers may be hooked on one or both ends. Fiber and platelet densities are not critical, and will preferably range from below 1 to 4 g/cm$^3$ or more.

In addition to fiber dimension, in determining a choice of fibers for a particular operation, while consideration must be given to all fiber properties, a key consideration, as indicated, will be fiber stiffness. Thus, fibers will be selected that have sufficient stiffness to promote or assist in removal of undesired fluid from a collection thereof in a wellbore. In general, however, as those skilled in the art will appreciate, the stiffness of fibers is related to their size and modulus, and must be considered in accordance with the deposit to be removed and transported. With this relationship in mind, fibers with tensile modulus of about 2 GPa (gigapascals) or greater, measured at 25° C., are preferred, most preferably those having tensile moduli of from at least about 6 GPa to about 1000 GPa, measured at 25° C. However, organic polymers other than aramides, such as nylon, usually have lower modulus, and thicker, i.e., larger diameter fibers, will be required. The suitability of particular fibers for the particular case, in terms of fluid deposit reducing and fluid transport abilities, may be determined by appropriate routine testing.

Those skilled in the art will recognize that a dividing line between what constitute "platelets", on one hand, and "fibers", on the other, tends to be arbitrary, with platelets being distinguished practically from fibers by having two dimensions of comparable size both of which are significantly larger than the third dimension, fibers, as indicated, generally having one dimension significantly larger than the other two, which are similar in size. As used herein, the terms "platelet" or "platelets" are employed in their ordinary sense, suggesting flatness or extension in two particular dimensions, rather than in one dimension, and also is understood to include mixtures of both differing types and sizes. In general, shavings, discs, wafers, films, and strips of the polymeric material(s) may be used. Conventionally, the term "aspect ratio" is understood to be the ratio of one dimension, especially a dimension of a surface, to another dimension. As used herein, the phrase is taken to indicate the ratio of the diameter of the surface area of the largest side of a segment of material, treating or assuming such segment surface area to be circular, to the thickness of the material (on average). Accordingly, the platelets utilized in the invention will possess an average aspect ratio of from about 10 to about 10,000, preferably 100 to 1000. Preferably, the platelets will be larger than 5 $\mu$m in the shortest dimension, the dimensions of a platelet which may be used in the invention being, for example, 5 $\mu$m×2 mm.×15 $\mu$m. Stiffness or tensile modulus requirements (GPa) would be analogous to those for fibers.

As indicated, the chemical nature of the materials from which the fibers or platelets of the invention are formed is not a key variable. Generally, the fibers and/or platelets should not react with the wellbore fluid or other components thereof or the undesired fluid(s) to be removed and transported, and/or dissolve in the wellbore fluid or the undesired fluid(s), at a rate or rates such that the effect of the fibers and/or platelets in deposit reduction and transport of the undesired fluid(s) to the surface is significantly reduced, or the deposit reduction and transport of the undesired fluid(s) to the surface is otherwise significantly inhibited. This "inertness" and suitability of a particular fiber or platelet material may be determined by routine testing. Accordingly, the fibers and/or platelets employed in the invention may be chosen from a wide variety of materials, assuming the fibers and/or platelets meet the requirements described herein. Thus, natural and synthetic fibers and platelets, particularly synthetic organic fibers and platelets, and especially those that are biodegradable or composed of synthetic organic polymers or elastomers, as well as particular inorganic materials, or any type of fiber comprising mixtures of such materials, may be employed. For example, fibers or platelets composed of or derived from cellulose, keratin (e.g., wool), acrylic acid, aramides, glass, acrylonitrile, novoloids, polyamides, vinylidene, olefins, diolefins, polyester, polyurethane, vinyl alcohol, vinyl chloride, metals (e.g., steel), carbon, silica, and alumina, may be used. Preferred fiber types include rayon, acetate, triacetate, (cellulose group); nylon (polyamide), Nomex® and Kevlar® (polyaramides), acrylic, modacrylic, nitrile, polyester, saran (polyvinylidene chloride), spandex (polyurethane), vinyon (polyvinyl chloride), olefin, vinyl, halogenated olefin (e.g., Teflon®, polytetrafluoroethylene) (synthetic polymer group); azlon (regenerated, naturally occurring protein), and rubber (protein and rubber group). Fibers and platelets from synthetic organic polymers, including, as indicated, mixtures of the polymeric materials, are preferred for their ready availability, their relative chemical stability, and their low cost. Polyester fibers, such as Dacron® fibers, and polyolefins, such as polyethylene and polypropylene, are most preferred. Again, composite fibers, comprising natural and/or synthetic materials, may be employed. For example, a suitable composite fiber might comprise a core and sheath structure where the sheath material provides necessary stiffness, but degrades over a desired period of time, the core comprising a soft and water soluble material. As indicated more specifically hereinafter, species of the fibers described demonstrating a variety of absorption characteristics, e.g., super absorbency, may be used singly or in combinations to enhance fluid removal.

A great advantage of the invention is the ability to adapt the wellbore fluid-translocating fiber combination to the specific problem, i.e., the particular undesired fluid deposit. More particularly, deposits of undesired fluids may be aqueous, non-aqueous, or a combination of both. In the particular case, selection of the wellbore or cleanout fluid and fibers or platelets, or fibers and platelets combination employed may be made in light of the nature of the undesired fluid to be removed, while not precluding the use of commonly available and commonly employed fluids. For example, if the undesired fluid deposit to be removed is considered to be a heavy brine, the wellbore fluid employed may comprise diesel or other hydrocarbon fluid, fibers assisting in transport of the brine in or with the hydrocarbon fluid. On the other hand, if the collected deposit is believed hydrocarbonaceous in character, and thus of limited solubility in an aqueous fluid, the wellbore fluid may comprise an organic or hydrocarbon fluid, or if an aqueous wellbore fluid is to be employed, various solubilizing or emulsifying agents may be added to the aqueous wellbore fluid to improve inclusion of the deposit. In each case, the fibers and/or platelets may then be selected which provide the best "fit" for the operation. For example, to remove or to reduce an aqueous deposit, such as brine, in a wellbore, a non-aqueous wellbore fluid containing a mixture, say 70-30, of hydrophobic and hydrophilic fibers may be employed. If the hydrophilic fibers are selected from absorbent to highly absorbent fibers, in addition to the sweeping effect of the fibers, the absorbency of the hydrophilic fibers may be exploited to assist in removal of the deposit, the hydrophobic fibers further assisting in transport of the wetted fibers. Other combinations will be evident to those skilled in the art, and may include an aqueous wellbore fluid with hydrophobic fibers for removal or reduction of a hydrocarbon deposit. As those skilled in the art will be aware, further considerations in choosing the wellbore fluid to be employed include the treating temperature and amount and nature of the fluids to be removed and transported.

The fibers, or fibers and/or platelet-containing fluids used in the invention may be prepared in any suitable manner. The fibers and/or platelets may be blended offsite, or, preferably, the fibers and/or platelets are mixed with the fluid at the job site, preferably on the fly. In the case of some fibers, such as novoloid or glass fibers, the fibers should be "wetted" with a suitable fluid, such as water or a wellbore fluid, before or during mixing with the drilling or wellbore fluid, to allow better feeding of the fibers. Good mixing techniques should be employed to avoid "clumping" of the fibers and/or platelets.

The amount of fibers and/or platelets-containing fluid supplied or provided will be sufficient or effective, under wellbore annulus conditions, and in conjunction with the flow rate, to remove undesired collected liquid. Accordingly, the fibers and/or platelets-containing fluid may be provided until the desired level of removal of undesired fluid deposit is achieved. In most instances, as indicated, it will be preferred to pump the suspension of fibers and/or platelets only during a portion of a job, e.g., perhaps for 10–25% of the job. Cleanout effectiveness may be determined by appropriate inspection or analysis of returned fluid/fiber at a surface site.

According to the invention, the provision of or flow rate of the translocating fibers and/or platelets-containing fluid to the undesired fluid deposit and therefrom is at a rate at least sufficient to remove undesired fluid from the deposit. Generally, normal cleanout fluid pumping rates, with the presence of the fibers and/or platelets, will be sufficient. For example, pumping rates may range from 1 to 2 barrels per minute, and may be varied, as required, by those skilled in the art.

In the usual case, the wellbore fluid mixture will be processed at the surface to remove fibers and/or platelets, recovered undesired fluid, and any particles accompanying or transported, and leave fluid that may be reused, the separated fluid and any particles being sent to disposal. In such cases, the particular practice or equipment used for separation or removal is not a critical aspect of the invention, and any suitable separation procedure or equipment may be used. Standard equipment, such as settlers, may be used. In most instances, the fluid may then be returned for reuse. In some cases, as indicated, fibers may be "removed" by alternative procedures or mechanisms, e.g., by degradation or dissolution of the fibers, in or out of the wellbore. For example, a composite fiber type may be employed in which some or all of the fibers comprise a continuous phase and a discontinuous "droplet-like" phase, the later phase being slowly soluble in the wellbore fluid to allow a timed break-up of these fibers. Preferably, a wellbore procedure utilizing fiber dissolution or degradation will be employed only on a periodic basis to avoid substantial buildup of dissolved or by-product material in the drilling or wellbore fluid.

FIGS. 1 and 2 of the drawing illustrate schematically a preferred application of the invention in cleaning out a wellbore utilizing a coiled tubing operation. Without denominating all elements shown, the rig and string, indicated generally as 30 in FIG. 1, includes a conventional coiled tubing reel 31 which supplies a coiled tubing string 32 through standard tubing injection and wellhead equipment 33 into wellbore 34, the coiled tubing connecting with and communicating with downhole injector 35. According to the invention, a cleanout fluid, such as water, and containing 1.0 percent fibers, such as polyester fibers, for example, (Dacron® Type 205NSO), manufactured by and available from E. I. duPont de Nemours and Company, is provided to the tubing 32 at 36. Dacron® Type 205NSO is a polyester staple fiber chopped to 6 millimeters in length, is 1.5 denier (approximately 12 $\mu$m) and is coated with a water dispersible sizing agent. The fibers-containing fluid is then sent downhole through the coiled tubing 32 to and through the injector 35 at a normal cleanout circulation rate. The cleanout fluid is circulated through the annulus around the coiled tubing in wellbore 34, the fibers in the fluid assisting in removing heavy brine present in the wellbore, and the fluid containing undesired fluid and any particles also removed is removed at the surface through line 37. The fluid in line 37 is then sent to separation equipment, indicated generally as 38, where appropriate separation of components may be facilitated. For example, particles and at least a portion of the brine-containing fluid may be treated or removed. Cleanout fluid may be returned for reuse after make-up with fresh water (not shown) via line 39, while brine-containing fluid and any particulate matter may be sent to disposal. FIG. 2 represents an enlargement of a section of borehole 34 in which the deposit 50 of the undesired fluid, heavy brine, has developed. As illustrated, the fibers-containing fluid from coiled tubing 32 exits injector 35, returning through the annulus or space between the tubing 32 and the walls of wellbore 34. As the fibers-containing fluid contacts the collected fluid deposit 50, fluid in the deposit is swept by the fibers from the deposit and into the fluid, being illustrated as droplets among the fibers.

What is claimed is:

1. A method comprising contacting a deposit of undesired fluid in a wellbore with a wellbore fluid, in an amount and at a rate sufficient to remove undesired fluid from the deposit, the wellbore fluid comprising an effective amount of translocating fibers and/or platelets.

2. The method of claim 1 in which wellbore fluid, after contacting the deposit, is returned to the earth surface with undesired fluid from the deposit.

3. The method of claim 2 in which an effective amount of inert translocating fibers is employed.

4. The method of claim 3 in which individual fiber lengths are at least about 0.5 millimeter, with fiber diameters being at least about 5 microns, the fibers are selected from fibers having a tensile modulus of at least 2 GPa, measured at 25° C., and the fibers are present in a concentration of from 0.01 percent to about 10 percent by weight, based on the weight of the fluid.

5. The method of claim 4 in which the translocating fibers are selected from natural and synthetic organic fibers.

6. The method of claim 5 in which the fibers are selected from fibers of cellulose, keratin, acrylic acid, aramides, glass, acrylonitrile, novoloids, polyamides, vinylidene, olefins, diolefins, polyester, polyurethane, vinyl alcohol, vinyl chloride, metals, carbon, silica, and alumina.

7. The method of claim 4 in which wellbore fluid returned to the earth surface contains particulate matter from the wellbore.

8. The method of claim 4 in which the undesired fluid is brine or a hydrocarbon fluid.

9. The method of claim 3 in which individual fiber lengths are at least about 2 millimeters, with fiber diameters being at least about 5 microns, the fibers are selected from fibers having a tensile modulus of at least 6 GPa, measured at 25° C., and the fibers are present in a concentration of from 0.1 percent to about 5 percent by weight, based on the weight of the fluid.

10. The method of claim 9 in which the fibers selected include polyester fibers and nylon fibers.

11. The method of claim 9 in which individual fibers are mixtures of synthetic organic polymers.

12. The method of claim 3 in which the wellbore is a deviated wellbore and the wellbore fluid is provided to the wellbore through coiled tubing.

13. The method of claim 12 in which individual fiber lengths are at least about 2 millimeters, with fiber diameters being at least about 5 microns, the fibers are selected from fibers having a tensile modulus of at least 6 GPa, measured at 25° C., and the fibers are present in a concentration of from 0.1 percent to about 5 percent by weight, based on the weight of the fluid.

14. The method of claim 2 in which undesired fluid is removed from wellbore fluid returned to the earth surface.

15. The method of claim 14 in which an effective amount of inert translocating fibers is employed.

16. The method of claim 15 in which individual fiber lengths are at least about 0.5 millimeter, with fiber diameters being at least about 5 microns, the fibers are selected from fibers having a tensile modulus of at least 2 GPa, measured at 25° C., and the fibers are present in a concentration of from 0.01 percent to about 10 percent by weight, based on the weight of the fluid.

17. The method of claim 16 in which the translocating fibers are selected from natural and synthetic organic fibers.

18. The method of claim 17 in which the fibers are selected from fibers of cellulose, keratin, acrylic acid, aramides, glass, acrylonitrile, novoloids, polyamides, vinylidene, olefins, diolefins, polyester, polyurethane, vinyl alcohol, vinyl chloride, metals, carbon, silica, and alumina.

19. The method of claim 16 in which wellbore fluid returned to the earth surface contains particulate matter from the wellbore.

20. The method of claim 16 in which the undesired fluid is brine or a hydrocarbon fluid.

21. The method of claim 15 in which individual fiber lengths are at least about 2 millimeters, with fiber diameters being at least about 5 microns, the fibers are selected from fibers having a tensile modulus of at least 6 GPa, measured at 25° C., and the fibers are present in a concentration of from 0.1 percent to about 5 percent by weight, based on the weight of the fluid.

22. The method of claim 21 in which the fibers selected include polyester fibers and nylon fibers.

23. The method of claim 2 in which translocating fibers and/or platelets and undesired fluid are removed from wellbore fluid returned to the earth surface.

24. The method of claim 23 in which an effective amount of inert translocating fibers is employed.

25. The method of claim 24 in which individual fiber lengths are at least about 0.5 millimeter, with fiber diameters being at least about 5 microns, the fibers are selected from fibers having a tensile modulus of at least 2 GPa, measured at 25° C., and the fibers are present in a concentration of from 0.01 percent to about 10 percent by weight, based on the weight of the fluid.

26. The method of claim 25 in which the translocating fibers are selected from natural and synthetic organic fibers.

27. The method of claim 26 in which the fibers are selected from fibers of cellulose, keratin, acrylic acid, aramides, glass, acrylonitrile, novoloids, polyamides, vinylidene, olefins, diolefins, polyester, polyurethane, vinyl alcohol, vinyl chloride, metals, carbon, silica, and alumina.

28. The method of claim 24 in which individual fiber lengths are at least about 2 millimeters, with fiber diameters being at least about 5 microns, the fibers are selected from fibers having a tensile modulus of at least 6 GPa, measured at 25° C., and the fibers are present in a concentration of from 0.1 percent to about 5 percent by weight, based on the weight of the fluid.

29. The method of claim 28 in which the fibers selected include polyester fibers and nylon fibers.

30. The method of claim 2 in which an effective amount of inert translocating platelets is employed.

31. The method of claim 1 in which the translocating fibers are biodegradable.

32. The method of claim 1 in which the translocating fibers are composite fibers.

33. The method of claim 1 in which an effective amount of inert translocating platelets is employed.

34. The method of claim 1 in which the wellbore is a deviated wellbore and the wellbore fluid is provided to the wellbore through coiled tubing.

35. The method of claim 1 in which individual fibers are mixtures of synthetic organic polymers.

* * * * *